United States Patent [19]

Pelliccia

[11] 4,390,922

[45] Jun. 28, 1983

[54] VIBRATION SENSOR AND ELECTRICAL POWER SHUT OFF DEVICE

[76] Inventor: Raymond A. Pelliccia, 221 Garrett Ave., Chula Vista, Calif. 92010

[21] Appl. No.: 345,920

[22] Filed: Feb. 4, 1982

[51] Int. Cl.[3] ..... H01H 35/14

[52] U.S. Cl. ..... 361/170; 307/117; 200/61.45 R

[58] Field of Search ..... 361/170; 307/117; 340/566, 602; 200/52 A, 61.45 R, 61.52

[56] References Cited

U.S. PATENT DOCUMENTS 3,714,456 1/1973 Krohmer et al. ..... 307/117

3,798,594 3/1974 Funk ..... 200/61.45 X 4,359,722 11/1982 Voldez et al. ..... 307/117 X

FOREIGN PATENT DOCUMENTS 1256550 2/1961 France ..... 200/61.45 R

*Primary Examiner*—Harry E. Moose, Jr.

*Attorney, Agent, or Firm*—Brown & Martin

[57] ABSTRACT

A vibration sensor and electrical power shut off device including a pendulum switch constructed for universal movement whereby vibration in any direction causes the pendulum switch to close and actuate a solenoid that shuts off electrical power at a switch point in an electrical power line, a low voltage circuit remaining energized to indicate power interruption.

2 Claims, 3 Drawing Figures

VIBRATION SENSOR AND ELECTRICAL POWER SHUT OFF DEVICE

BACKGROUND OF THE INVENTION

The present invention relates to a safety device for detecting vibration such as seismic shocks and cutting off an electrical power supply when such vibrations occur.

One of the big dangers that results from earthquakes is the shorting of power lines to create fire and shock hazards before appropriate action can be taken. A device is needed to quickly and effectively interrupt the power when such an occurrence takes place.

Various typs of switching devices have been proposed in the part. U.S. Pat. No. 4,103,697 discloses such a device utilizing a pendulum with a post engaging a pad on a spring loaded finger that extends into a pocket 24 on a spring loaded arm. Movement of the pendulum causes mechanical disengagement of the post from the pad and the finger is moved upward out of the pocket or latch with the arm 20 being moved inward by another spring to close a gas valve. This device is costly and mechanical in operation. There is the possibility that the post can hang up on the pad. Also, the operation of the device depends upon the springs and their tension.

U.S. Pat. No. 4,028,510 shows a device using a pair of mechanical straps with small protuberances holding a weight in position. Vibration of the device shakes the straps and the weight falls against a weight support member, spreading the straps against spring tension. The shock must be sufficient to release the upper protuberances from the keeper member 38. The end of the rod contacts a switch located in the bottom of the device. This device is complicated and requires careful balance. Again, since it is entirely mechanical, there is a danger of the parts hanging up.

U.S. Pat. No. 4,262,289 shows a pendulum operated alarm switch. No means is shown for cutting off a power supply. The metal straps holding the switch contacts might not close if the force is exerted along the edge of the straps rather than the face of the straps. The device includes gears and adjusting means which render it expensive to manufacture.

U.S. Pat. No. 3,858,131 shows a switch device for an alarm. It includes a resilient arm with switch contacts on it. Electromagnetic means is provided to maintain the resilient arm in the neutral position when movement of the arm is not desired. Dual contacts are required to operate the device with four contact points and the four contact arms. Two electromagnets are also required. Again, force acting at a right angle to the contact arms will not close the contacts as desired to actuate the alarm. No means is provided for shutting off a power source.

U.S. Pat. No. 2,912,535 discloses a complex temperature and earthquake responsive switch. A ball moves off its centered position when vibration occurs and the associated shaft is tilted as shown in FIG. 3 of the drawings. A spring urges the moveable contact member out of engagement from one contact and into engagement with the alarm contact. This device is complicated and involves mechanical unseating of the rod from the projection on the moveable contact element.

It is an object of the present invention to provide a new and improved device for interrupting electrical power when dangerous vibrations occur such as with an earthquake, which device is simple in construction and positive in operation without requiring springs, gears and other comparable items.

It is a further object of the present invention to provide such a new and improved device that is sensitive and does not depend upon mechanical operations for energizing the device.

It is another object of the present invention to provide such a new and improved device that is practical to build and that includes simple means for testing the device and for resetting it after it has been actuated.

SUMMARY OF THE INVENTION

The above objects are attained by an exemplary embodiment of the invention shown in the drawings including a universally moveable pendulum with a conductive element surrounding by a contact ring whereby movement of the pendulum in any direction causes a conductive element to touch the contact ring and close circuit means which interrupts the electrical power supply. Interruption is caused by positive acting elements that assure operation. Means is provided for testing the operation of the device and for indicating whether it is in the power on or power off mode.

DETAILED DESCRIPTION OF THE INVENTION

Figure 1:
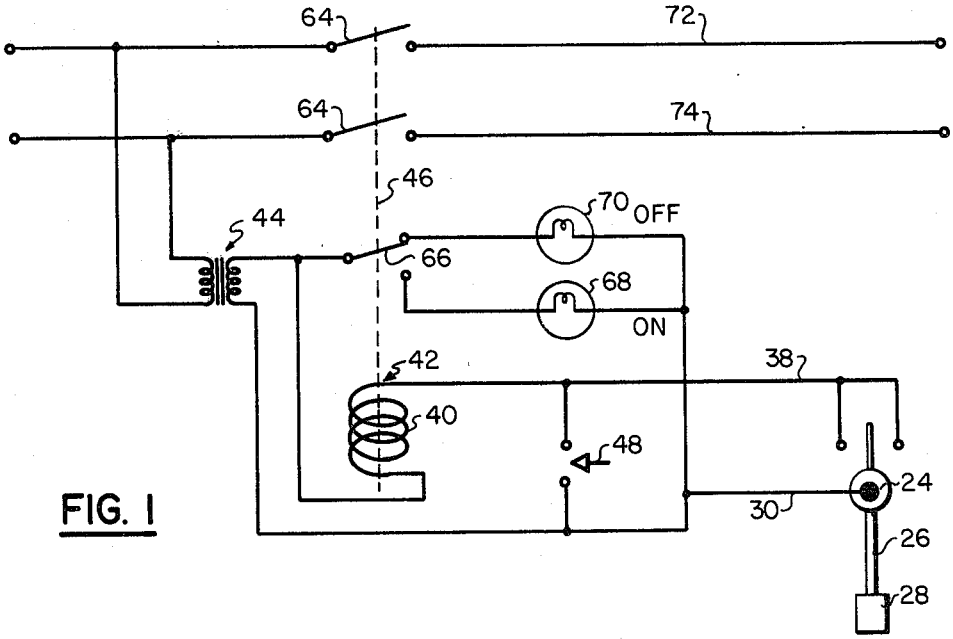
FIG. 1 is a schematic diagram of a device embodying the present invention showing the electrical circuit.

Referring to the drawings, a cabinet or housing is shown in broken line 10. A support 12 is mounted in the housing 10. A hollow cylindrical cup 14 of insulating material is affixed to the support 12. The cup includes a seating ring 16 of electrically conductive material seated in a circular support platform 18 formed in the cup 14. The seating ring includes a flange 20 seated in a groove in the platform. The center of the seating ring includes a rounded support 22 that seats a metal ball 24 formed on a metal conductive rod 26. The lower end of the rod 26 includes a weight 28. Thus, the rod 26, ball 24 and weight 28 form a pendulum member with universal movement. An electric wire 30 is connected to the ring 16 and extends out through an opening 32 in the cup for incorporation into a circuit as explained later.

A second seat is formed near the top of the cup for a ring 34. A conductive metal ring 36 seats on this ledge with an electric wire 38 connected thereto. Thus, when the rod 26 is deflected, a circuit is completed through wire 30, ball support 22, ball 24, rod 26, ring 36 and wire 38.

Wire 38 connects through the coil 40 of solenoid 42 and the secondary of a transformer 44 through to wire 30 so that the solenoid 42 and the transformer 44 are connected in the circuit described above. The solenoid includes axially moveable rod 46. This circuit also includes a test switch 48 which can be closed across the wires 30 and 38 to close the solenoid circuit and energize the solenoid for testing.

Figure 2:
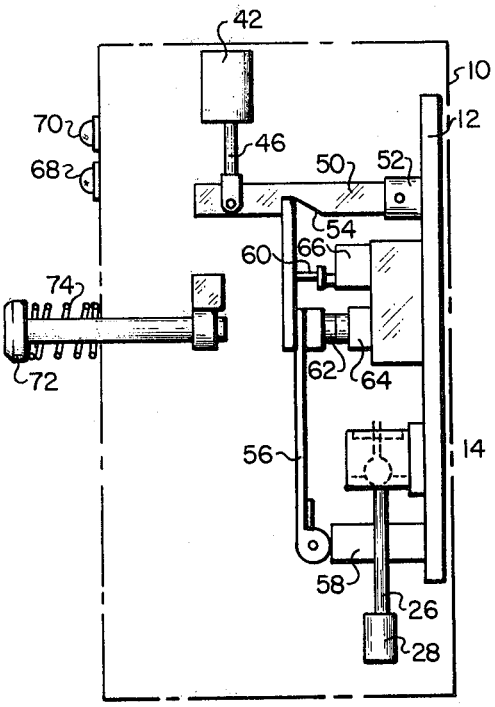
FIG. 2 is a side elevation of the device of FIG. 1 showing the details of construction.
Figure 3:
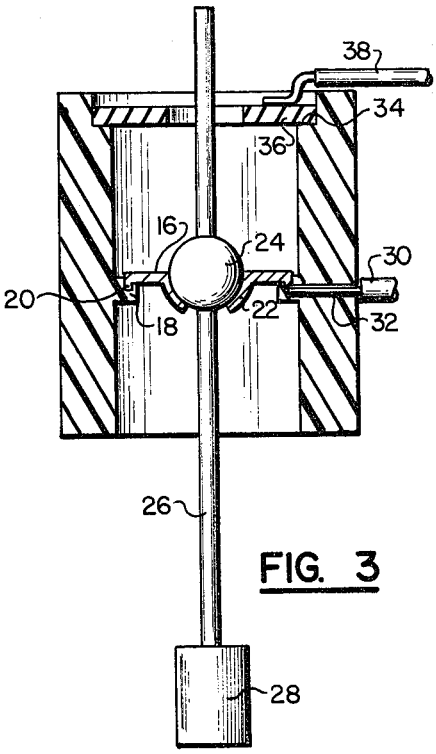
FIG. 3 is an enlarged sectional view of the pendulum and contact arrangement.

A solenoid rod 46 is pivotally connected at its lower end to one end of a latch arm 50 (FIG. 2). The other end of the latch arm 50 is pivotally connected to a bracket 52 on support 12. The latch arm includes a notch 54 which forms a shoulder for seating the end of a pivotal switch limb 56. The switch limb 56 is pivotally connected at the bottom to bracket 58 which is mounted on support 12. In the position shown in FIG. 2 of the drawings, the switch limb 56 slants slightly to the left when it is engaged in the notch 54 of the latch arm 50 so that it will automatically rotate to the left around its pivot point if it is disengaged from the latch arm 50.

The switch limb 56 includes pushbutton members 60 and 62 that engage the switch buttons on switches 64 and 66. Switch 66 energizes a green "on" light 68 or a red "off" light 70 depending upon the position of switch 66 determined by the solenoid 42.

A reset button 72 extends out of the front of the cabinet 10 and is forced outward by the spring 74 that is seated against the front of the cabinet. After the power circuit is open and the switch limb 56 rotates to the left out of the notch 54 in the latch arm 50, it can be reset in the notch by pushing inward on the reset button 72.

OPERATION

When a vibration of sufficient intensity occurs, the pendulum 28 swings and the pendulum rod 26 closes the circuit between wires 30 and 32. This energizes the solenoid 42 and the solenoid rod 46 is pulled upward. The solenoid rod 46 moves the latch arm 50 upward and the switch limb 56 rotates to the left in FIG. 2 opening the switch 64 and moving the switch 66 to the off position, lighting the off light 70 to indicate the status of the device.

The main power lines 72 and 74 are opened to the right of the switch 64 in FIG. 1 so that power to the right, to a building for example, is interrupted. Power to the left of the switch 64 is maintained to light the "off" lamp 70 and to hold the solenoid 42 in the energized position. When the vibration stops, the pendulum weight 28 returns to the neutral position. After investigation to determine that it is safe to restore the power to the building, the rest butting 72 is pressed to engage the switch limb 56 and return it to the position where it engages the notch 54 in latch arm 50 as shown in FIG. 2. This moves the solenoid rod up, de-energizing the solenoid, and closes the switch 64 to restore power. The switch 66 also is moved by the solenoid rod 46 to shut off the "off" lamp and light the "on" lamp.

The present invention provides a simple and effective vibration detector that automatically interrupts a power line.

Having thus described my invention, I claim:

1. A vibration detection and electrical power shut off device for interrupting electrical power in a power line when vibrations sensed by the device exceeded a predetermined intensity, comprising:

a pendulum switch member suspended for universal movement and including a rod and a weight at the bottom of said rod, said rod including electrical contact means, and said pendulum switch member being electrically connected to solenoid means;

a contact ring of electrically conductive material surrounding said electrical contact means on said rod in close proximity thereto;

solenoid means connected to said contact ring and to switching means in an electrical power line, said solenoid means being mounted with its actuator rod extending substantially vertical and downward;

a latch arm pivotally mounted at one end to support means, the other end of said arm being pivotally mounted to said solenoid actuator rod with a lock notch in said arm between its ends;

a switch limb pivotally mounted at its lower end to pivot means on said support means and extending upward so that its free end can position in said notch in the power on position, the limb being positioned slightly over center relative to the pivot means so that it has a tendency to fall outward;

power switch means mounted on said support means; and light indicator switch means mounted on said support means;

whereby said pendulum moves with vibration and the contact means on said rod touches the contact ring to energize the solenoid means causing said solenoid actuator rod to lift said latch arm upward and release said switch limb whereby it falls outward by gravitational force, opening the power switch means and switching the light indicator switch means to the on position.

2. A vibration detection and electrical power shut off device according to claim 1 including a spring loaded reset rod mounted on the front of said housing whereby pressing in on said rod against spring pressure mechanically moves said switch limb around its pivotal axis toward the back of said housing and moves said latch arm and solenoid rod upward for seating the upper end of said switch limb in said notch and engaging said power switch means and light indicator switch means.

* * * * *